US005827206A

United States Patent [19]

Lunter

[11] Patent Number: 5,827,206

[45] Date of Patent: Oct. 27, 1998

[54] DRY HYDROMASSAGE CHAIR

[75] Inventor: Paul Lunter, Clearwater, Fla.

[73] Assignee: JTL Enterprises, Inc.

[21] Appl. No.: 734,294

[22] Filed: Oct. 21, 1996

[51] Int. Cl.[6] ..... A61H 9/00

[52] U.S. Cl. ..... 601/148; 601/148

[58] Field of Search ..... 601/49, 55, 86, 601/90, 98, 148–150, 156, 158, 160

[56] References Cited

U.S. PATENT DOCUMENTS

| | | | |
|---|---|---|---|
| 3,595,223 | 7/1971 | Castagna . | |
| 4,139,001 | 2/1979 | Macabee . | |
| 4,258,706 | 3/1981 | Shank | 601/55 |
| 4,607,405 | 8/1986 | Ellis et al. | 601/148 X |
| 4,635,619 | 1/1987 | Diamond . | |
| 4,635,620 | 1/1987 | Ricchio | 601/148 |
| 4,839,930 | 6/1989 | Watkins . | |
| 4,853,988 | 8/1989 | Mützell . | |
| 4,976,256 | 12/1990 | Marlin et al. | 601/55 |
| 5,074,286 | 12/1991 | Gillaspie et al. . | |
| 5,387,181 | 2/1995 | Olsen | 601/158 X |
| 5,503,618 | 4/1996 | Rey . | |
| 5,514,078 | 5/1996 | Palmer | 601/148 X |
| 5,540,651 | 7/1996 | Risch et al. | 601/148 |

FOREIGN PATENT DOCUMENTS

| | | | |
|---|---|---|---|
| 404361753 | 12/1992 | Japan | 601/149 |
| 406205811 | 7/1994 | Japan | 601/156 |

*Primary Examiner*—Danton D. DeMille
*Attorney, Agent, or Firm*—Kennedy Covington Lobdell & Hickman, LLP

[57] ABSTRACT

An apparatus for performing dry hydromassage includes an assembly for supporting a user including a body having an opening formed therein with a membrane attached to the body in covering relation with the opening. Fluid reservoirs provided in fluid communication with the body and an assembly for directing a stream of fluid against the membrane for dry hydromassage of a user disposed on the support assembly is provided. The apparatus further includes an assembly for circulating fluid between the reservoir and the assembly for directing a stream of fluid against the membrane.

20 Claims, 4 Drawing Sheets

DRY HYDROMASSAGE CHAIR

BACKGROUND OF THE INVENTION

The present invention relates broadly to apparatus for directing fluid at a body of a user for massaging that part of the user's body under water bombardment, known as hydromassage. More specifically, the present invention relates to a hydromassage chair for dry hydromassage of a user's back.

Dry hydromassage involves using water or another fluid to bombard a portion of a person's body while keeping the person isolated from the fluid and, consequently, dry. In order to accomplish dry hydromassage, a membrane is disposed intermediate the water and the user such that the water bombards the membrane which translates the force of the water into disruptions of the outer membrane surface against the user's body to stimulate that part of the body in contact with the membrane. Therefore, the term dry hydromassage is used to describe massage which isolates the user from the massaging fluid.

Several known structures are provided to accomplish dry hydromassage. Rey U.S. Pat. No. 5,503,618 discloses a hydromassage pillow for use in an automobile. There, an assembly is provided within a hollow cushion and an apparatus to propel water against the inner surface of the cushion to massage whatever part of the person's body is in contact with the cushion. The Rey hydromassage pillow is powered from a vehicular cigarette lighter socket.

Gillaspie et al U.S. Pat. No. 5,074,286 discloses a massage table on which a person may receive dry hydromassage from underneath the table surface. These devices are acceptable for what they are intended to accomplish. Nevertheless, none of the devices provide an apparatus on which a person may sit in a comfortable position after a workout or during periods of stress and receive a dry hydromassage.

SUMMARY OF THE INVENTION

It is accordingly an object of the present invention to provide an apparatus for performing dry hydromassage which is formed as a chair for relaxed sitting while receiving a massage.

It is another object of the present invention to provide such a massage chair which supports a person's back using both the body of the chair and the massage membrane.

It is additionally an object of the present invention to provide such a massage chair which provides stimulating massage under controlled conditions.

To that end, an apparatus for performing dry hydromassage includes an assembly for supporting a user including a body having an opening formed therein; a membrane attached to the body in covering relation with the opening; a fluid reservoir in fluid communication with the body; an assembly for directing a stream of fluid from the reservoir against the membrane for dry hydromassage of a user disposed on the support and an arrangement for circulating fluid between the reservoir and the assembly for directing a stream of fluid from the reservoir against the membrane.

It is preferred that the assembly for supporting a user is formed as a chair having a generally horizontally extending support surface in a generally vertically extending support surface for supporting a user in a seated position. It is further preferred that the membrane covered opening be formed in the generally vertically extending support surface. It is also preferred that the assembly for supporting a user be contoured with the generally vertically extending support surface curving smoothly into the generally horizontally extending support surface. The generally vertically extending support surface and the membrane preferably combine to form a support surface for a user disposed on the apparatus.

It is preferred that the assembly for circulating fluid between the reservoir and the assembly for directing a stream of fluid from the reservoir against the membrane include an electrically driven pump. Further, this circulating assembly preferably includes the aforesaid pump, a manifold, an associated piping mounted to the body in fluid communication with the assembly for directing a stream of fluid from the reservoir against the membrane for dry hydromassage of a user disposed on the support assembly.

It is further preferred that the assembly for directing a stream of fluid against the membrane include a plurality of jets projecting from the manifold in fluid communication therewith and disposed in a manner to direct fluid against the membrane. Preferentially, the present invention further includes an assembly for adjusting the pressure of fluid emitted from the jets to vary the impact pressure of the fluid on the membrane, and, therefore on a user disposed on the apparatus. It is further preferred that the pump, manifold, jets and associated piping are configured to produce a circulation rate of at least 60 gallons per minute.

Additionally, the apparatus of the present invention may preferably include an assembly for monitoring and controlling the temperature of any fluid circulating within the circulating assembly. Further, the monitoring and controlling assembly includes a temperature sensor, a heater, a cooling unit and an assembly for controlling activity of the heater and the cooling unit responsive to a signal from the temperature sensor. It is preferred that the heater be an electric heater mounted to the body in communication with the temperature sensor, the control assembly and the circulation assembly. The cooling assembly preferably includes a radiator and at least one fan mounted to the body for circulating air through the radiator to remove heat from any circulating fluid.

By the above, the present invention provides a unique dry hydromassage chair which may be used for leisure time activity and is constructed in a self-contained, compact unit.

DETAILED DESCRIPTION OF THE PREFERRED EMBODIMENT

Figure 1:
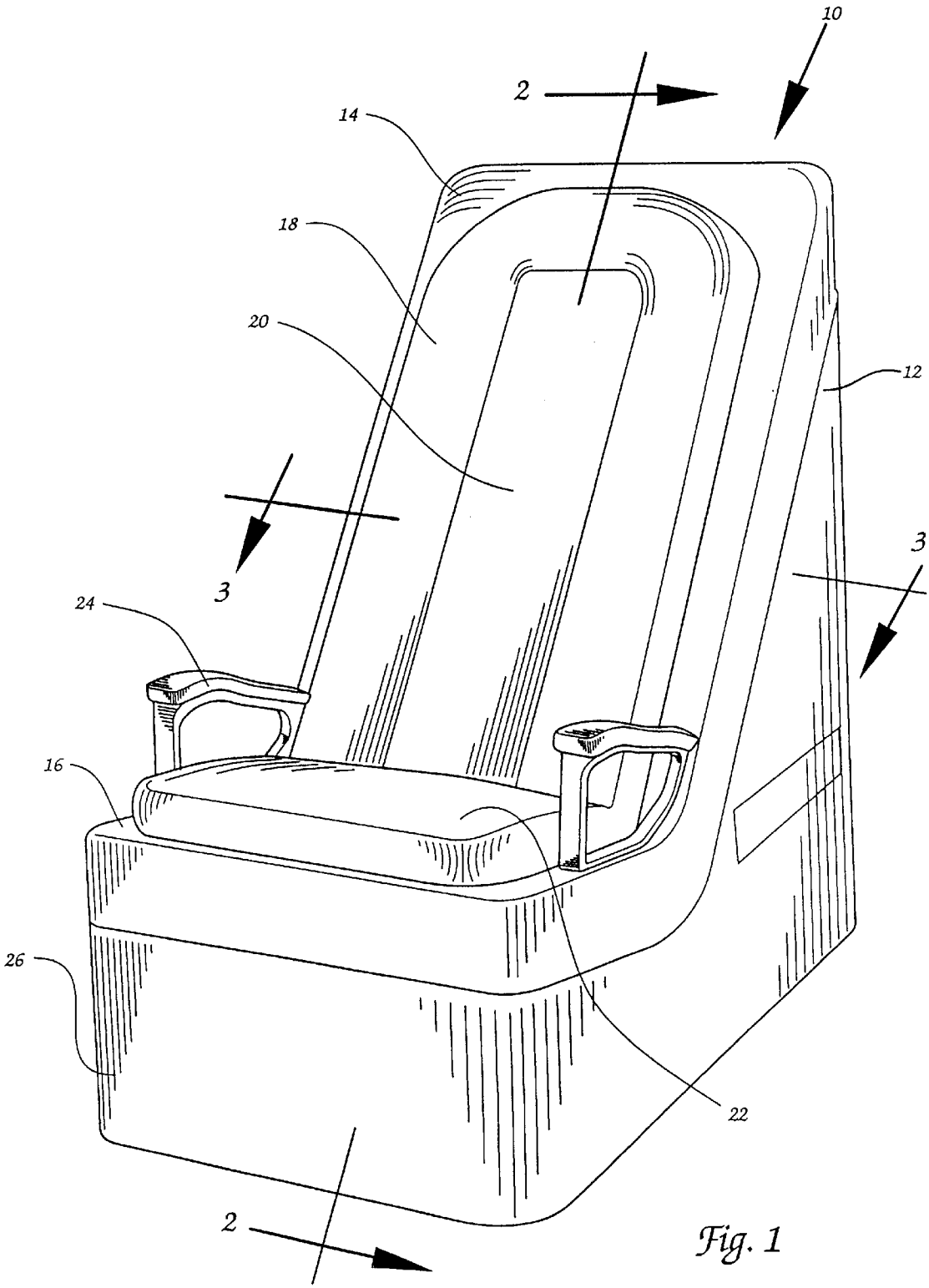
FIG. 1 is a perspective view of an apparatus for performing dry hydromassage according to the preferred embodiment of the present invention.

Turning now to the drawings and, more particularly, to FIG. 1, an apparatus for performing dry hydromassage is illustrated generally at 10 and includes a body 12 which is formed generally as a chair having a generally vertically extending support surface 14 curving smoothly into a generally horizontally extending support surface 16 supported by a contoured, floor-standing enclosure 26. A seating pad 22 is disposed on the generally horizontally extending surface 16 along with arm rests 24 disposed on either side of the cushion 22. The generally vertically extending surface 14 is fitted with a generally vertically extending cushion 18 having a membrane 20 disposed in approximately the center of the vertically extending cushion 18 and extending generally longitudinally therewith. The membrane 20 will be explained in greater detail hereinafter.

Figure 2:
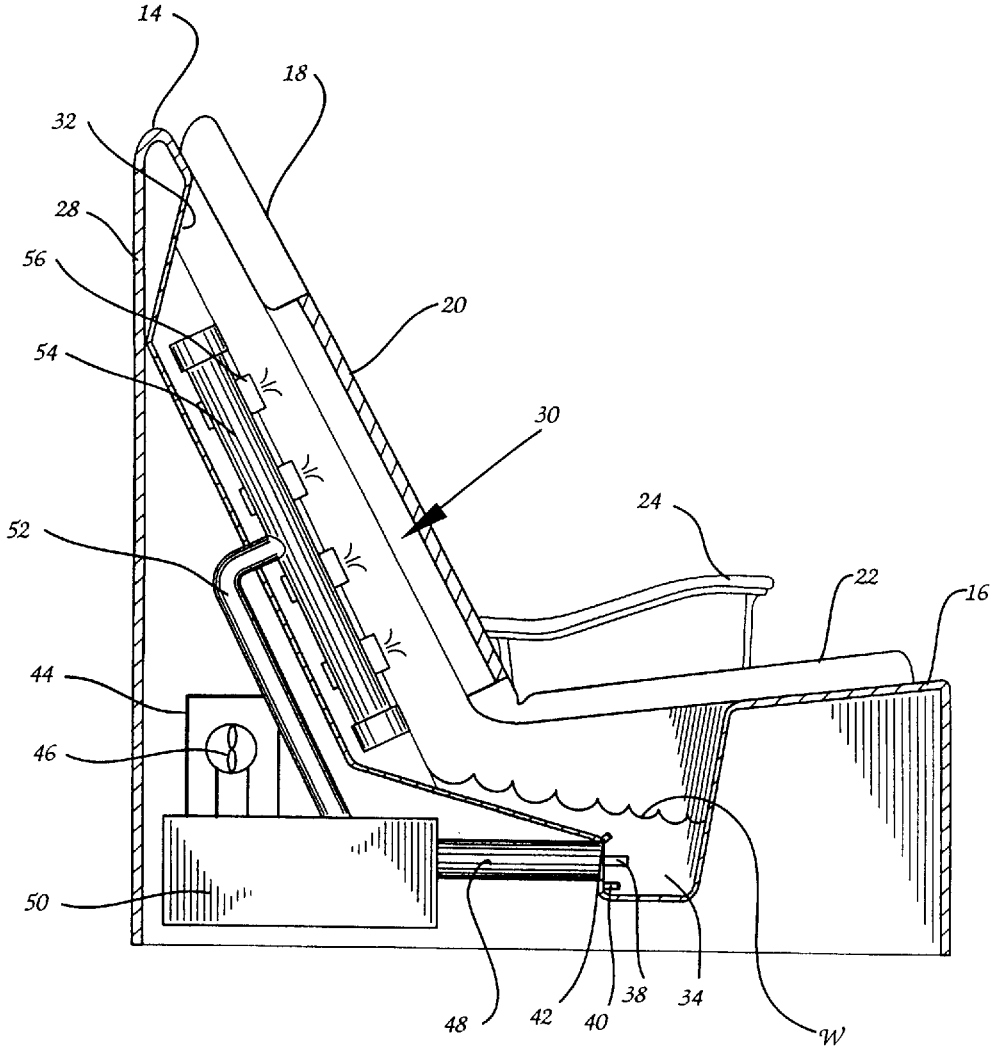
FIG. 2 is a side cutaway view of the apparatus for performing dry hydromassage illustrated in FIG. 1 and taken through line 2—2 thereof.
Figure 4:
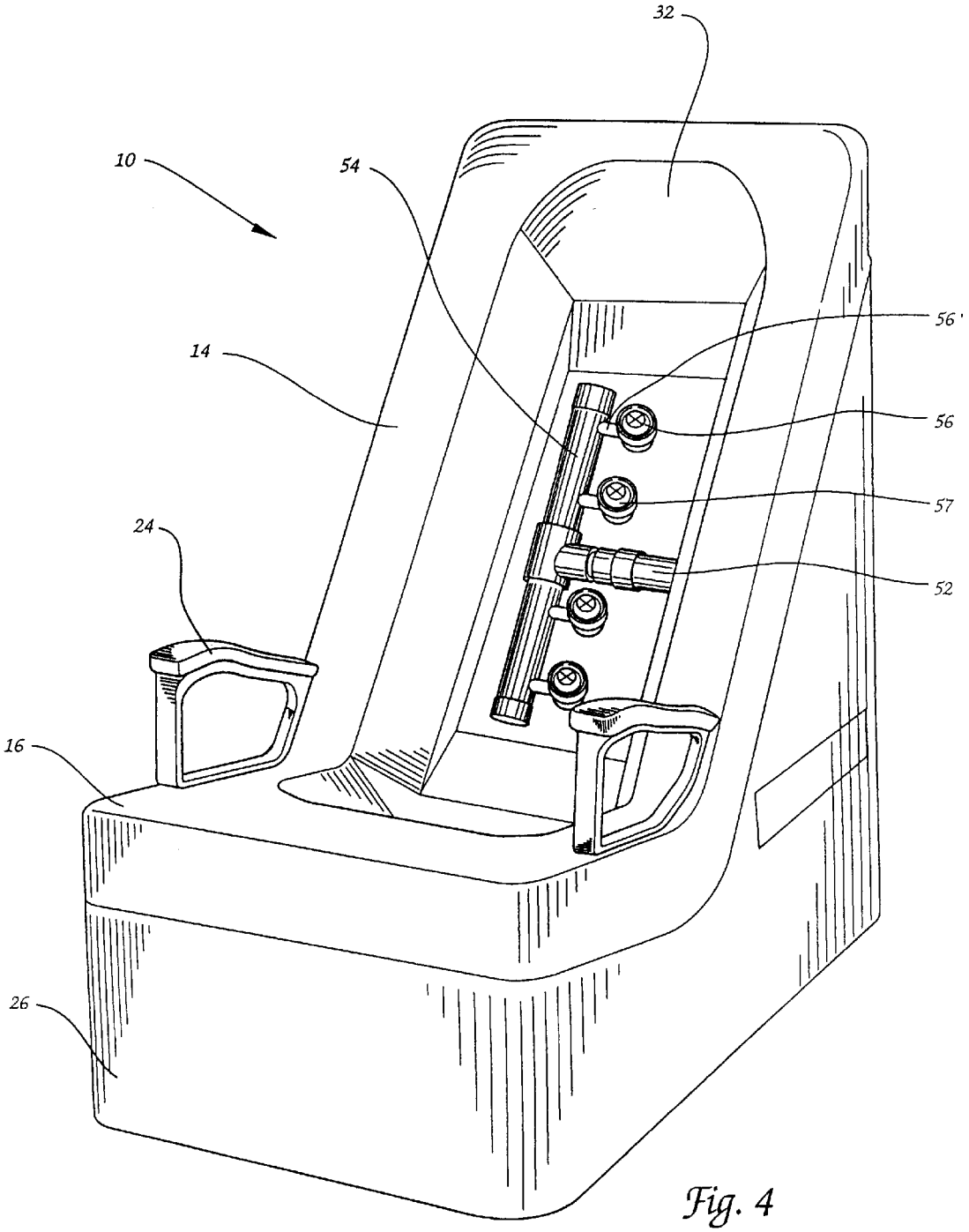
FIG. 4 is a perspective view of the apparatus for performing dry hydromassage illustrated in FIG. 1 with the membrane and seat cushions removed.

As seen in FIGS. 2 and 4, an opening 30 is provided in the cushion 18 allowing access to the membrane 20 from the back side of the cushion 18. A well 32 is formed in the body 12 as best seen in FIGS. 2 and 4. The well 32 extends from an area adjacent an upper portion of the generally vertically extending surface 14 to a position underneath the horizontal cushion 22 where it intersects with the generally horizontally extending surface 16. The horizontally extending portion of the well 32 defines a reservoir 34 for containing the massaging fluid. It is preferred that the massaging or work fluid be water, but it will be appreciated by those skilled in the art that other liquids may be used as well to provide a fluid bombardment massage. The water capacity of the device is eight gallons, but the apparatus can be operated with as little as four gallons. It should be noted that, due to the configuration of the membrane 20 in the generally vertically extending cushion 18, support for the user is provided by both the generally vertically extending cushion 18 and the membrane 20.

All the components necessary to perform the dry hydromassage function of the present invention are contained within the body 12. Nevertheless, it will be understood by those skilled in the art that the necessary components may lie outside the body 12 without departing from the spirit and scope of the present invention. A circulating system is provided for circulating water, illustrated generally at W in FIG. 2. The circulating system includes a pump 50, which may be an electrical pump, a manifold 56, a effluent pipe 52 extending therebetween, and an intake pipe 48 extending from the reservoir 34 to the pump 50. For best results, the intake, or suction, pipe 48 should be 2.0 inches in diameter, while the effluent pipe is 1.5 inches in diameter.

As seen in FIG. 4, the manifold 52 is a generally tubular member having the effluent pipe 52 joined thereto in fluid communication therewith. The effluent pipe 52 enters the manifold 54 at approximately the midsection thereof for distribution of fluid upwardly and downwardly within the generally vertically oriented manifold 52. The manifold 54 is connected to a plurality of jets 56 which are mounted in fluid communication thereto and disposed in a linear array in a position in direct alignment with the membrane 22 via the membrane opening 30.

A system for directing the pumped water against the membrane 20 takes the form of four jets 56 mounted to small pipes 56' projecting outwardly from the manifold 54 in a linear, vertically distributed array. There are two jets 56 above the effluent pipe 52 and two jets 56 below the effluent pipe 52. The jets are nozzle-like structures configured for creating a pulsing, rotating stream of water for bombardment of the membrane 20 as best seen in FIG. 2.

The present invention also includes several control functions and associated devices. Initially, a water depth sensor 42 is provided which may be configured to activate an alarm should the water level decrease below the minimum four gallon requirement. Additionally, a temperature sensor 40 is provided to determine the temperature of the water. The depth sensor 42 and the temperature sensor 40 are conventional items illustrated as being disposed in the reservoir, but it is not beyond the artisan's skill to relocate the sensors. Further, the water may be heated or cooled. To that end, a heater element 38 is provided for electrical resistance heating of the water in the reservoir 34. A cooler is provided in the form of a radiator 44 and a fan 46. Preferably, two 220 cfm fans are used to blow cooling air across radiator fins attached to conventional radiator tubes into which the water is directed for cooling. Therefore, the water may be heated or cooled depending on the temperature requirements of the user. The temperature adjustment may be configured to occur automatically responsive to a signal from the temperature sensor 40 and a manual setpoint device.

Figure 3:
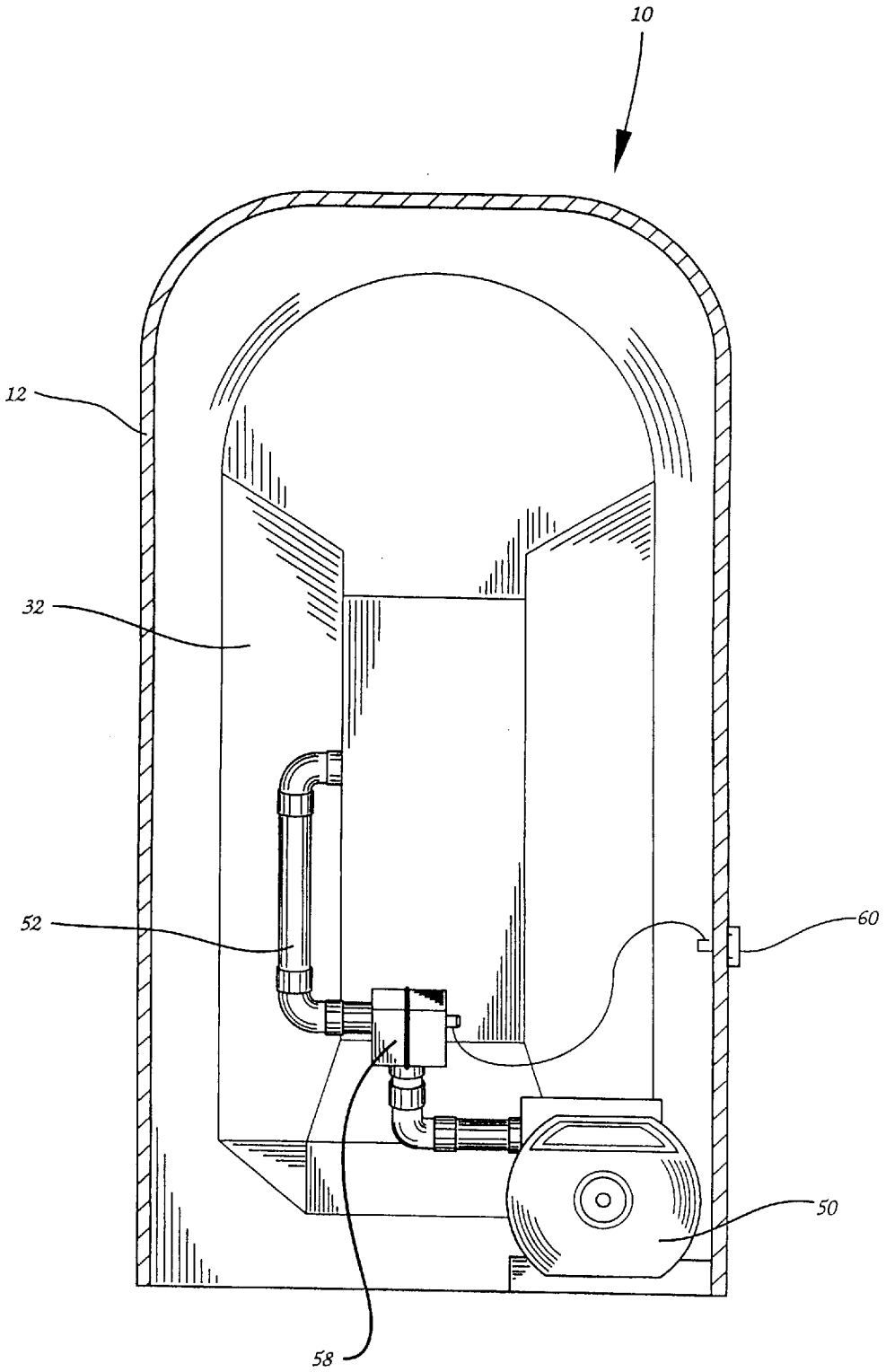
FIG. 3 is a rear cutaway view of the apparatus for performing dry hydromassage illustrated in FIG. 1 and taken through line 3—3 thereof.

Another control is provided and is seen in FIG. 3. There, a knob 60 is attached to a valve operator which controls a conventional valve encased in covering 58. This valve may be adjusted to alter fluid flow to the manifold 54 and, accordingly, to alter the impact force of the water emitted from the jets 56. As is known, by reducing the flow of water to the jets, the jet output is lowered, thereby lowering the impact force of the water on the membrane 20 and, consequently, on the user.

In operation, the user assumes a seated position on the device 10 and the pump 50 is activated, causing a water flow from the reservoir 34 through the intake pipe 48 which may or may not go through the radiator 44 for cooling. The water, whether from the radiator 44 or straight from the pump 50, is directed upwardly through the effluent pipe 52 and into the manifold 54. The jets 56 direct the water outwardly against the membrane 20 for massaging the back of a user. The water drains from the membrane 20 into the reservoir 34 and, once again, commences the cycle described above.

By the above, the present invention provides a simple and effective apparatus for use during dry hydromassage. The unique apparatus will provide an effective dry hydromassage chair for use in medical facilities and sports medical, as well as for leisure and home use.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A chair for performing dry hydro-massage on a user in a seated position, comprising:

a chair body for supporting a user in a seated position having a seat portion for supporting a user's lower body and a seat back for supporting a user's upper body, said seat back including a seat back support surface defining an elongate opening disposed approximately in the center of said seat back and surrounded at the top and sides by said seat back support surface, said opening oriented to extend centrally along a user's spinal area when seated on said chair body;

a membrane attached to said chair body in covering relation with said opening;

a fluid reservoir in fluid communication with said chair body;

means for directing a stream of fluid against said membrane for dry hydro-massage along the spinal area of a user seated on said chair body; and a circulation system for circulating fluid between said reservoir and said means for directing a stream of fluid against said membrane.

2. An apparatus for performing dry hydro-massage according to claim 1 wherein said seat portion is formed as a generally horizontally extending support surface and said seat back support surface extends generally vertically to said seat portion.

3. An apparatus for performing dry hydro-massage according to claim 2 wherein said chair body is contoured with said generally vertically extending seat back support surface curving smoothly into said generally horizontally extending seat portion support surface.

4. An apparatus for performing dry hydro-massage according to claim 1 wherein said circulation system includes an electrically driven pump.

5. An apparatus for performing dry hydro-massage according to claim 1 wherein said circulation system includes a pump, a manifold, and associated piping mounted to said chair body in fluid communication with said means for directing a stream of fluid against said membrane.

6. An apparatus for performing dry hydro-massage according to claim 5 wherein said means for directing a stream of fluid against said membrane includes a plurality of jets projecting from said manifold in fluid communication therewith and wherein said means for directing a stream of fluid against said membrane is disposed in a manner to direct fluid only against said membrane.

7. An apparatus for performing dry hydro-massage according to claim 6 and further comprising means for adjusting the pressure of fluid emitted from said jets to vary the impact pressure of the fluid on said membrane.

8. An apparatus for performing dry hydro-massage according to claim 6 wherein said pump, manifold, jets and associated piping are configured to produce a circulation rate of at least sixty gallons per minute.

9. An apparatus for performing dry hydro-massage according to claim 1 and further comprising means for monitoring and controlling the temperature of any fluid circulating within said circulation system.

10. An apparatus for performing dry hydro-massage according to claim 9 wherein said means for monitoring and controlling the temperature of circulating fluid includes a temperature sensor, a heater, a cooling unit and means for controlling activity of said heater and cooling unit responsive to a signal from said temperature sensor.

11. An apparatus for performing dry hydro-massage according to claim 10 wherein said heater is an electric heater mounted to said chair body in communication with said temperature sensor, said control means, and said circulation system.

12. An apparatus for performing dry hydro-massage according to claim 10 wherein said cooling unit includes a radiator and at least one fan mounted to said chair body for circulating air through said radiator to remove heat from any circulating fluid.

13. An apparatus for performing dry hydro-massage according to claim 1 wherein said seat back support surface and said membrane together support the user's upper body.

14. An apparatus for performing dry hydro-massage comprising:

(a) a chair body for supporting a user in a seated position having a generally horizontally extending seat portion and a generally vertically extending seat back, said seat back comprising both (i) a seat back cushion surrounding an elongate opening at a top and sides thereof, said elongate opening extending centrally along said seat back generally normal with respect to said seat portion to extend centrally along a user's spinal area when seated on said chair body and (ii) a flexible membrane attached to said chair body in covering relation with said opening;

(b) a fluid reservoir in fluid communication with said chair body;

(c) means for directing a stream of fluid against said membrane for dry hydro-massage along the spinal area of a user seated on said body; and (d) a circulation system for circulating fluid between said reservoir and said means for directing a stream of fluid against said membrane.

15. An apparatus for performing dry hydro-massage according to claim 14 wherein said chair body is contoured with said seat back curving smoothly into said seat portion.

16. An apparatus for performing dry hydro-massage according to claim 14 wherein said circulation system includes an electrically driven pump.

17. An apparatus for performing dry hydro-massage according to claim 14 wherein said means for directing a stream of fluid against said membrane for dry hydro-massage includes a plurality of jets disposed alongside said opening and said means for directing a stream of fluid is disposed to direct fluid only against said membrane;

said circulation system includes a pump, a manifold communicating with said plurality of jets, and associated piping mounted to said chair body in fluid communication between said pump and said reservoir, and between said pump and said manifold for delivering multiple streams of fluid from said jets against said membrane, and said circulation system and said means for directing a stream of fluid against said membrane are configured to produce a circulation rate of at least sixty gallons per minute.

18. An apparatus for performing dry hydro-massage according to claim 14 wherein said heater is an electric heater mounted to said chair body in communication with said temperature sensor, said control means, and said circulation system.

19. An apparatus for performing dry hydro-massage according to claim 14 wherein said cooling means includes a radiator and at least one fan mounted to said chair body for circulating air through said radiator to remove heat from any circulating fluid.

20. An apparatus for performing dry hydro-massage according to claim 15 wherein said seat back cushion and said membrane together support the user's upper body.

* * * * *